US005644816A

United States Patent [19]

Chou

[11] Patent Number: 5,644,816

[45] Date of Patent: Jul. 8, 1997

[54] EXTENSIBLE DRAWBAR DEVICE OF A TRUNK

[76] Inventor: Cheng-Tsan Chou, 27, Lane 280, Chung Zhen Road, Chin Quan Li, Sa Lu, Taichung, Taiwan

[21] Appl. No.: 610,471

[22] Filed: Mar. 4, 1996

[51] Int. Cl.[6] ..... B25G 1/04

[52] U.S. Cl. ..... 16/115; 190/18 A; 280/47.315; 280/47.371

[58] Field of Search ..... 16/115; 190/18 A, 190/18 R, 104, 115, 117; 280/37, 47.371, 655, 655.1, 47.315

[56] References Cited

U.S. PATENT DOCUMENTS

| | | | |
|---|---|---|---|
| 5,379,486 | 1/1995 | Wang | 16/115 |
| 5,400,472 | 3/1995 | Chang | 16/115 |
| 5,438,731 | 8/1995 | Kazmark, Jr. | 16/115 |
| 5,447,217 | 9/1995 | Chou | 190/18 A |

*Primary Examiner*—Chuck Y. Mah

*Attorney, Agent, or Firm*—Peterson, Wicks, Nemer & Kamrath, P.A.

[57] ABSTRACT

An extensible drawbar device comprises a grip, a draw plate disposed under the grip transversely, two parallel drawbars connected by the draw plate, two fixed plates receiving the drawbars, and two link plates abutting the drawbars. The grip is connected to two upper ends of the drawbars. A groove is formed on the upper portion of each drawbar. Two ends of the draw plate are inserted in the grooves and connected to the upper ends of the link plates. Two compression springs are disposed between the grip and the draw plate. Caging recesses are formed on the draw plate. A through hole is formed on the grip to receive a push button. The lower end of the push button stably connects a caging block. The lower end of the link plate has a generally ladder-shaped plate which has a first and second steps, a bevel, and a slot. A caging hole is formed at the lower portion of the drawbar. Positioning holes are formed on the upper portion of the fixed plate. A positioning stopper which is restrained by a spring is inserted in the caging hole and the positioning hole.

2 Claims, 5 Drawing Sheets

F I G • 4

EXTENSIBLE DRAWBAR DEVICE OF A TRUNK

BACKGROUND OF THE INVENTION

The invention relates to an extensible drawbar device of a trunk.

There are many types of extensible drawbar devices of trunks. However, most drawbar devices have very complex structures. Therefore, the drawbar devices will become useless if one or more critical element is broken. The critical elements may be a screw, a pin, a rivet, and a connecting rod depending on the structures of the drawbar devices. Once the critical element is broken, the drawbar device may not be extended after retraction. Otherwise, the drawbar device may not be retracted after extension.

SUMMARY OF THE INVENTION

An object of the present invention is to provide an extensible drawbar device of a trunk which has a simplified structure to elongate the period of usage.

Another object of the present invention is to provide an extensible drawbar device of a trunk which has a simplified structure to improve the quality of the product.

Another object of the present invention is to provide an extensible drawbar device of a trunk which has a simplified structure to reduce the cost of manufacture.

Accordingly, an extensible drawbar device comprises a grip, a draw plate disposed under the grip transversely, two parallel drawbars connected by the draw plate movably, two fixed plates receiving the corresponding drawbars, and two link plates adjacent to the corresponding drawbars. The grip connected to two upper ends of the corresponding drawback fixedly. A groove is formed on the upper portion of each drawbar and inserted in the corresponding grooves. Two ends of the draw plate are connected to the upper ends of the corresponding link plates. Two compression springs are disposed between the grip and the draw plate. A plurality of caging recesses are formed on the draw plate. A through hole is formed on the grip. A push button is inserted in the through hole. The lower end of the push button stably connects a caging block which is disposed between the grip and the draw plate. The lower end of the link plate has a generally ladder-shaped plate. The ladder-shaped plate has a first step, a second step, a bevel between the first step and the second step, and a slot on the ladder-shaped plate. The second step has a curved distal end. A caging hole is formed at the lower portion of the drawbar. A plurality of positioning holes are formed on the upper portion of the fixed plate. A positioning stopper which is restrained by a restrained spring is inserted in the caging hole and the corresponding positioning hole. The positioning stopper has a rear flange abutting the slot. One end of the restrained spring is inserted in the bottom of the positioning stopper. When the push button is pushed rightward, the caging block engages with the caging recess. The draw plate is lifted upward. The bevel pushes the rear flange so that the positioning stopper moves from the first step to the second step. The positioning stopper disengages with the caging hole and the corresponding positioning hole. The positioning stopper is positioned in the drawbar. Thus the drawbar can be extended.

DETAILED DESCRIPTION OF THE INVENTION

Figure 1:
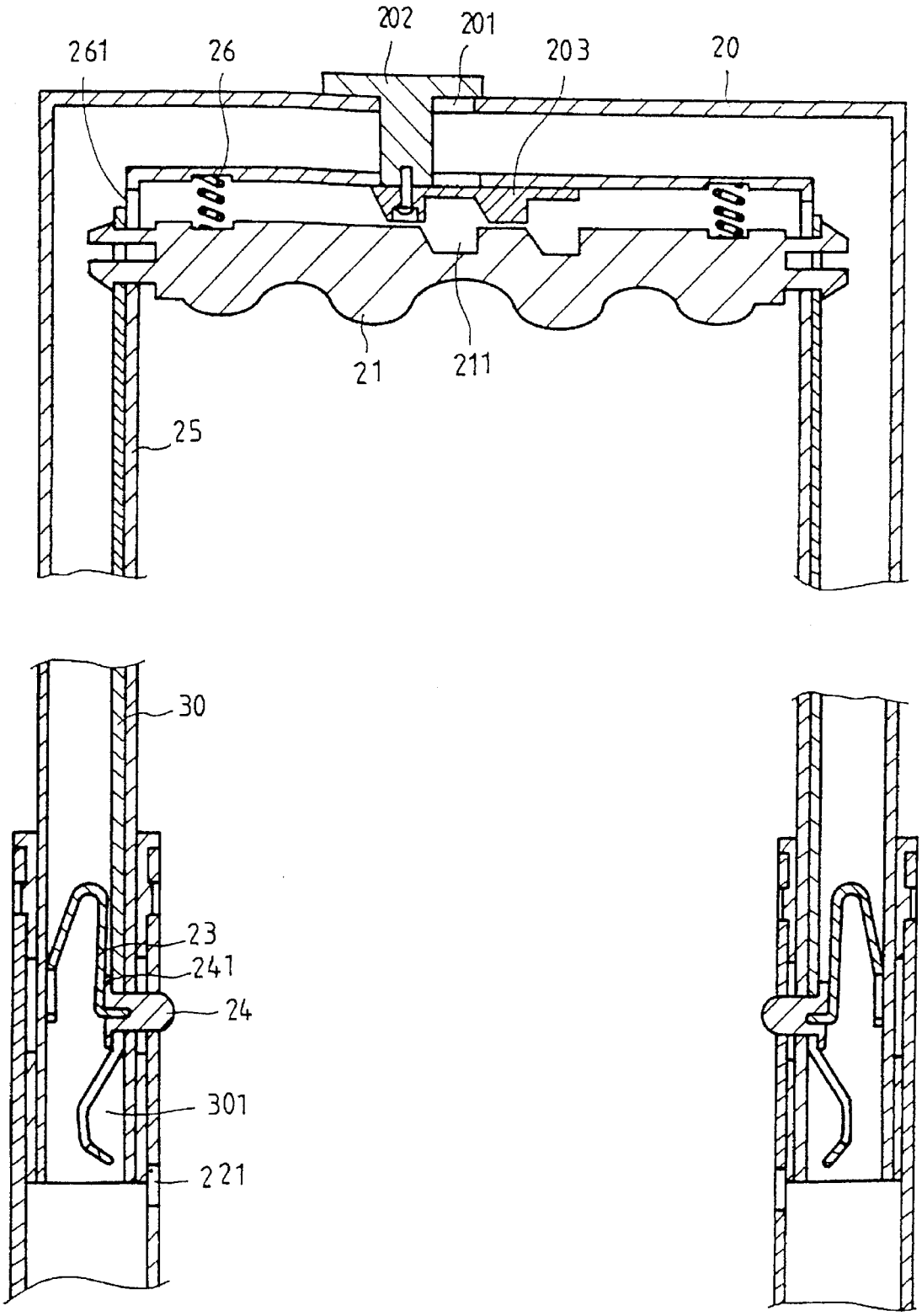
FIG. 1 is a partially cross-sectional view of an extensible drawbar device of a preferred embodiment in accordance with the invention.
Figure 2:
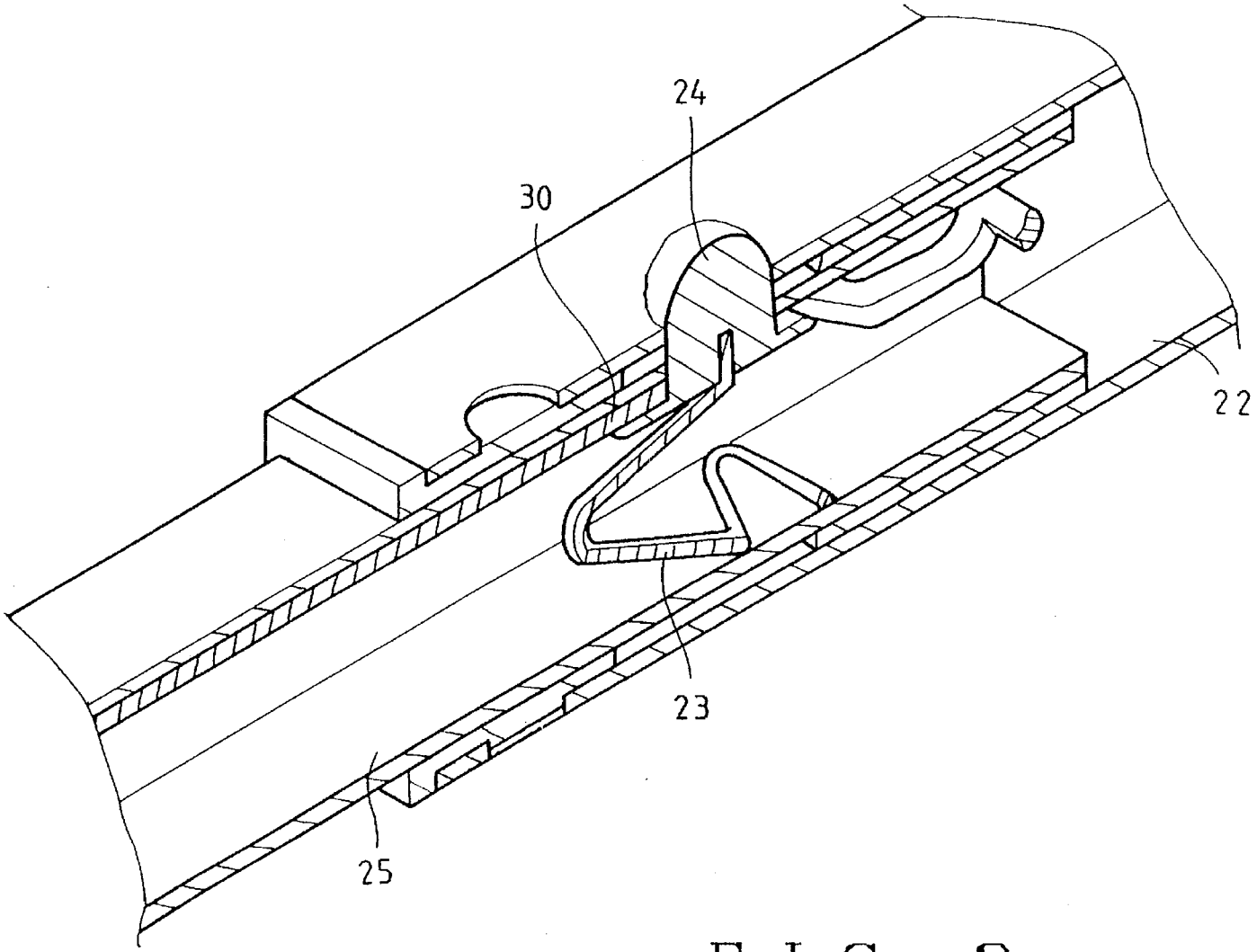
FIG. 2 is a partially cross-sectional, assembly view of a link plate and a positioning stopper.
Figure 3:
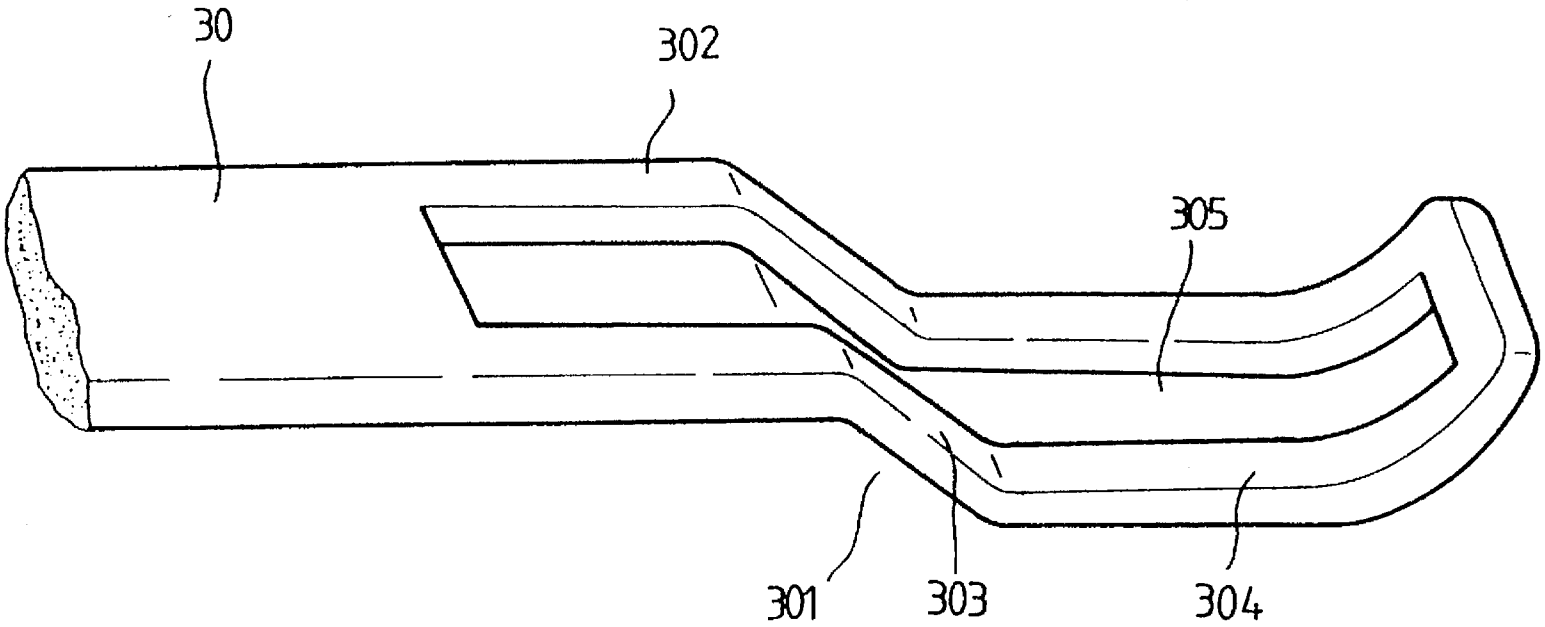
FIG. 3 is a partially perspective view of a link plate.

Referring to FIG. 1, an extensible drawbar device comprises a grip 20, a draw plate 21 disposed under the grip 20 transversely, two parallel drawbars 25 connected by the draw plate 21 movably, two fixed plates 22 receiving the corresponding drawbars 25, and two link plates 30 adjacent to the corresponding drawbars 25.

Referring to FIGS. 1 to 4, the grip 20 is connected to two upper ends of the corresponding drawbars 25 fixedly. A groove 261 is formed on the upper portion of each drawbar 25. Two ends of the draw plate 21 are inserted in the corresponding grooves 261 and connected to the upper ends of the corresponding link plates 30. Two compression springs 26 are disposed between the grip 20 and the draw plate 21. A plurality of caging recesses 211 are formed on the draw plate 21. A through hole 201 is formed on the grip 20. A push button 202 is inserted in the through hole 201. The lower end of the push button 202 stably connects a caging block 203 which is disposed between the grip 20 and the draw plate 21. The lower end of the link plate 30 has a generally ladder-shaped plate 301. The ladder-shaped plate 301 has a first step 302, a second step 304, a bevel 303 between the first step 302 and the second step 304, and a slot 305 on the ladder-shaped plate 301. The second step 304 has a curved distal end. A caging hole 251 is formed at the lower portion of the drawbar 25. A plurality of positioning holes 221 are formed on the upper portion of the fixed plate 22. A positioning stopper 24 which is restrained by a restrained spring 23 is inserted in the caging hole 251 and the corresponding positioning hole 221. The positioning stopper 24 has a rear flange 241 abutting the slot 305. One end of the restrained spring 23 is inserted in the bottom of the positioning stopper 24.

Figure 4:
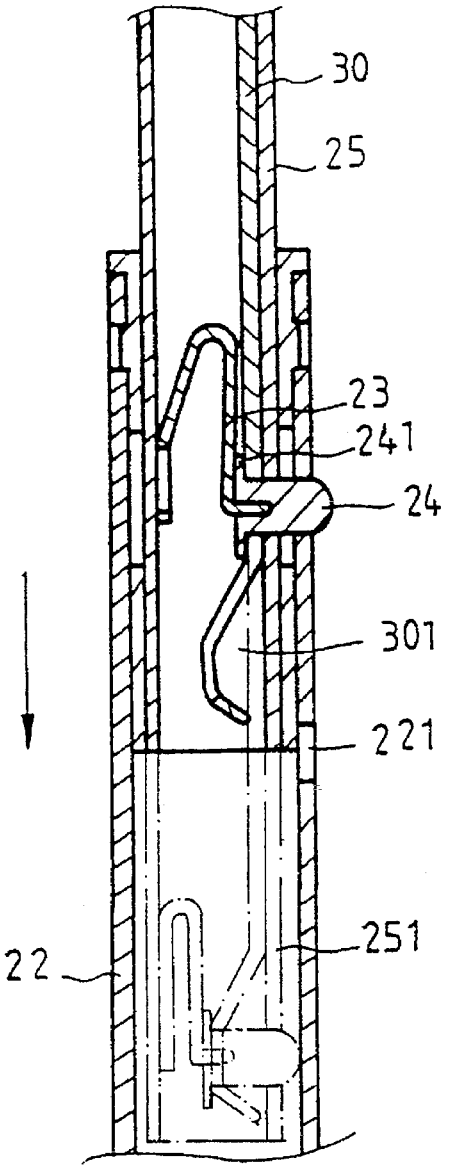
FIG. 4 is a schematic view illustrating the operation of a link plate and a positioning stopper in a drawbar.
Figure 5:
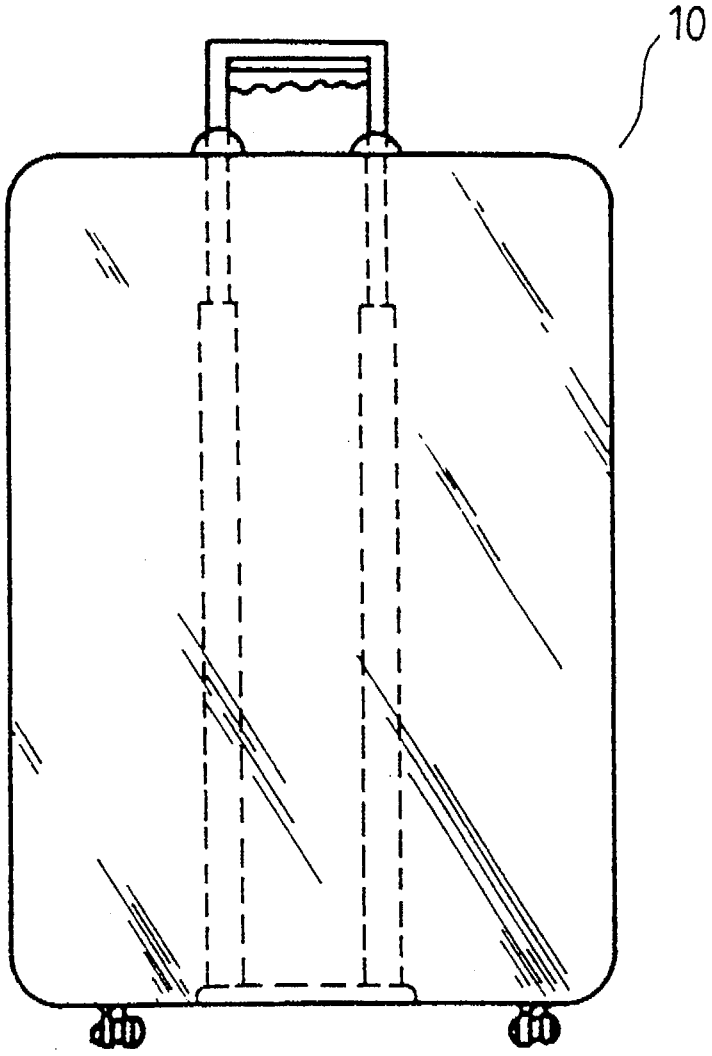
FIG. 5 is a schematic view illustrating the position of an extensible drawbar device in a trunk.

Referring to FIGS. 1 and 4, the operation of the extensible drawbar device is clearly illustrated. FIG. 1 shows the caging block 203 disengaged with the caging recess 211. The push button 202 locks the extensible drawbar device on the trunk 10 (as shown in FIG. 5). When the push button 202 is pushed rightward, the caging block 203 engages with the caging recess 211. The draw plate 21 is lifted upward. The bevel 303 pushes the rear flange 241 so that the positioning stopper 24 moves from the first step 302 to the second step 304. The positioning stopper 24 disengages with the caging hole 251 and the corresponding positioning hole 221. The positioning stopper 24 is positioned in the drawbar 25. Thus the drawbar 25 can be extended.

The invention is not limited to the above embodiment but various modifications thereof may be made. Further, various changes in form and detail may be made without departing from the scope of the invention.

I claim:

1. An extensible drawbar device comprising:

a grip;

two parallel drawbars having upper ends connected to said grip;

two link plates adjacent to said corresponding drawbars, respectively;

two fixed plates receiving said corresponding drawbars and link plates;

a groove formed on an upper portion of each said drawbar;

a draw plate disposed under said grip transversely to said drawbars and having two ends inserted in said corresponding grooves, respectively;

said two ends of said draw plate connected to two upper ends of said corresponding link plates, respectively;

a lower end of each said link plate having a generally ladder-shaped plate;

said ladder-shaped plate having a first step, a second step, a bevel between said first step and said second step, and a slot on said ladder-shaped plate;

said second step having a curved distal end;

a caging hole formed at a lower portion of each said drawbar;

a plurality of positioning holes formed on an upper portion of each said fixed plate;

a positioning stopper which is restrained by a restrained spring and inserted in each said caging hole and said corresponding positioning hole;

said positioning stopper each having a rear flange abutting said slot; and one end of each said restrained spring inserted in a bottom of said positioning stopper;

wherein when said draw plate is lifted upward, said bevel pushes said rear flange so that each of said positioning stopper moves from said first step to said second step, disengages with said caging hole and said corresponding positioning hole, and is positioned in the drawbar, and said drawbars may be extended.

2. The extensible drawbar device of claim 1 further comprising, in combination:

two compression springs disposed between said grip and said draw plate;

a plurality of caging recesses formed on said draw plate;

a through hole formed on said grip;

a push button inserted in said through hole; and a lower end of said push button stably connecting a caging block which is disposed between said grip and said draw plate, wherein the push button can be pushed to position said caging block to be engaged or disengaged with said caging recess.

* * * * *